US005649197A

United States Patent [19]

Fujita

[11] Patent Number: 5,649,197

[45] Date of Patent: Jul. 15, 1997

[54] DEVELOPMENT APPARATUS INCLUDING NONMAGNETIC SINGLE-COMPONENT DEVELOPER GUIDE MEMBER

[75] Inventor: Hideaki Fujita, Tenri, Japan

[73] Assignee: Sharp Kabushiki Kaisha, Osaka, Japan

[21] Appl. No.: 582,342

[22] Filed: Jan. 19, 1996

[30] Foreign Application Priority Data

Jan. 20, 1995 [JP] Japan ..... 7-007738

[51] Int. Cl.[6] ..... G03G 21/00

[52] U.S. Cl. ..... 399/260; 399/284

[58] Field of Search ..... 355/245, 246, 355/250, 251, 253, 254, 259, 260; 118/651, 653, 655, 656, 657, 660, 661

[56] References Cited

U.S. PATENT DOCUMENTS

| | | | |
|---|---|---|---|
| 4,083,326 | 4/1978 | Kroll et al. . | |
| 4,194,830 | 3/1980 | Ohnuma et al. . | |
| 4,566,402 | 1/1986 | Shimazaki . | |
| 4,836,135 | 6/1989 | Kohyama et al. | 118/653 |
| 5,128,716 | 7/1992 | Kita | 355/253 X |
| 5,185,632 | 2/1993 | Yoshida et al. . | |
| 5,448,341 | 9/1995 | Nagahara et al. | 355/251 |
| 5,475,477 | 12/1995 | Tanuma et al. | 355/259 |

FOREIGN PATENT DOCUMENTS

| | | |
|---|---|---|
| 0323252 | 7/1989 | European Pat. Off. . |
| 572000A1 | 12/1993 | European Pat. Off. . |
| 0572000A1 | 12/1993 | European Pat. Off. . |
| 3439280 | 5/1985 | Germany . |
| 58-098762 | 6/1983 | Japan . |
| 59-86071 | 5/1984 | Japan . |
| 59-86072 | 5/1984 | Japan . |
| 1-195474 | 8/1989 | Japan . |
| 2-191974 | 7/1990 | Japan . |
| 3-046677 | 2/1991 | Japan . |
| 4-5190 | 1/1992 | Japan . |

*Primary Examiner*—Shuk Lee

[57] ABSTRACT

A development apparatus includes a developer guide member in a position on an upstream side of a blade in a rotating direction of a developing roller, where the developer guide member does not come into contact with the developing roller. The developer guide member is formed of an elastic body or an elastic foam body. The developer guide member prevents toner which is regulated by the blade from flowing upward from the blade, and allows the toner to efficiently flow underneath the blade. Therefore, with an image forming apparatus using toner as a nonmagnetic single-component developer, it is possible to obtain high-density image quality. It is also possible to provide a development apparatus, in a simple and inexpensive construction, which decreases deterioration of the toner and the apparatus with time.

13 Claims, 12 Drawing Sheets

DEVELOPMENT APPARATUS INCLUDING NONMAGNETIC SINGLE-COMPONENT DEVELOPER GUIDE MEMBER

FIELD OF THE INVENTION

The present invention relates to development apparatuses for use in image forming apparatuses employing an electrophotographic method, for example, copying machines, printers, facsimile machines and electrostatic recording devices.

BACKGROUND OF THE INVENTION

A single-component developer including only toner, and a two-component developer including toner and carrier are known as developers for use in electrophotographic apparatuses. In a developing method using the two-component developer, toner is usually charged by agitating the toner and carrier in a developer reservoir so as to cause the toner to adhere to a surface of the carrier. The carrier having the toner adhering thereto is transported by the developer carrier to a development area where the developer carrier faces an electrostatic latent image carrier. Consequently, a sufficient amount of developer is transported, and a high-density image is obtained. However, when the two-component developer is used, in order to maintain the development density at a certain level, it is necessary to keep the mixing ratio of the toner and the carrier uniform, complicating the entire structure of a development apparatus.

Whereas a development apparatus using the single-component developer can be easily handled. A known example of the single-component developer (hereinafter just referred to as the toner) is a nonmagnetic single-component developer. In general, in a development apparatus that does not use a developer supply member for supplying and applying the nonmagnetic toner, the toner is usually transported to an area between the developer carrier and a nip section of a developer regulating member. More specifically, an amount of toner is transported to the area between the developer carrier and the nip section of the developer regulating member by a movement of the developer carrier. The amount of toner transported is decided by image force, mechanical adhesion such as Van der Waals force to the developer carrier, shearing force due to the flowability of the toner, and the shape of the developer carrier.

The developer regulating member is pressed against the developer carrier by a suitable pressure so as to produce an even thin layer of the toner. Accordingly, most of the toner transported by the movement of the developer carrier cannot pass through the developer regulating member.

Whether the transported toner on the developer carrier can pass through the developer regulating member or not (i.e., toner passing rate) is decided as follows. Namely, the toner passing rate is determined by the relation among the adhesion of the toner to the developer carrier, the toner transporting capacity by friction between the toner and the developer carrier, the pressure applied to the developer carrier by the developer regulating member, and friction between the developer regulating member and the toner.

There is a method for improving the toner supply capacity using a developer supply member (for example, a toner supply roller made of a sponge and the like) in a development apparatus. In this method, the supply of the toner is mechanically and electrically performed by pressing the developer supply member against the developer carrier. More specifically, the developer supply member improves the adhesion of the toner to the developer carrier due to the image force by charging the toner in a contact section between the developer supply member and the developer carrier. Moreover, since the developer supply member performs the function of applying the toner to the developer carrier, the toner passing rate is improved, the toner can easily pass through the developer regulating member, and a satisfactory toner supply capacity is achieved. In short, it is possible to supply a sufficient amount of toner.

A typical example of this kind of a development apparatus will be explained with reference to FIG. 13. First, an electrostatic image is formed on a surface of a photoreceptor 71 (electrostatic latent image carrier) by latent image forming means, not shown. Subsequently, the electrostatic image is developed into a visible form by adhering toner 76 (nonmagnetic single-component developer) to the electrostatic image using static electricity by means of a developing roller 72 (developer carrier) facing the photoreceptor 71.

In the development process, the charged toner 76 forms a thin layer on the developing roller 72. The formation of a thin layer of the toner 76 is performed as follows. First, the toner 76 is supplied and applied to the developing roller 72 by a toner supply roller 77 (developer supply member) which is installed in a developer reservoir 75 and pushed against the developing roller 72. Thereafter, the toner 76 adhering to the developing roller 72 is leveled to form a thin layer by a blade **74*a* as a regulating member of the developer regulating member 74**.

The toner 76 is usually charged by friction or injection of charges at least either in a section between the developing roller 72 and the toner supply roller 77 or in a section between the developing roller 72 and the blade **74*a***.

In the development apparatus using such a nonmagnetic single-component developer, transport of the toner by the carrier is not available. Therefore, when development which consumes a large amount of toner, for example, development of an entirely black-solid document, is performed, it is impossible to supply an amount of toner that compensates for the consumption of toner on the developing roller, causing an increase in the possibility of a gradual lowering of the density.

For example, using magnetic toner as a single-component developer instead of the nonmagnetic toner is a well known prior art for solving this problem. Namely, since the magnetic toner is magnetically attracted by a magnetic force and transported, it is possible to supply to the developing roller a sufficient amount of toner for compensating for the consumption of toner. However, since the magnetic toner is produced by adding magnetic powder to a principal material, it is difficult to color the magnetic toner and hard to correspond to a color image.

Therefore, using the nonmagnetic toner as the single-component developer brings advantage, However, this causes problems in transporting the toner, charging the toner, and leveling the toner into a thin layer on the developer carrier.

Specifically, with the use of the nonmagnetic toner, since the transport of toner using the magnetic force cannot be performed, it is necessary to modify the method for transporting toner. In contrast to the magnetic toner which adheres to the developing roller due to the magnetic force, the adhesion of the nonmagnetic toner to the developing roller is produced mainly by the image force and Van der Waals force. Therefore, if the toner layer is not thin, the toner falls down or flies from the developing roller. Additionally, when the toner is charged by friction between the toner and the developing roller or the blade, the amount of charge is in inverse proportion to the thickness of the toner layer. Thus, in order to achieve stably high charging of toner, it is necessary to form an even thin layer.

As a toner transporting method for a development apparatus using the nonmagnetic toner, a number of techniques have been disclosed as well as the method using the toner supply roller that is described above as an example of the prior art.

For example, Japanese Publication for Unexamined Patent Application (Tokukaisho) No. 58-98762 and U.S. Pat. No. 4,083,326 disclose methods using a fiber brush as the toner supply roller. Namely, toner held by the fiber brush is supplied by bringing the toner supply roller having the fiber brush on a surface thereof into contact with the developing roller. Moreover, Japanese Publication for Unexamined Patent Application (Tokukaihei) No. 2-191974 discloses a method using an elastic foam body as the toner supply roller. In this method, the toner is supplied by arranging an expanded cell of the elastic foam body to contain the toner.

However, when the toner supply roller made of the fiber brush or the elastic foam body is used, it is necessary to push the toner supply roller against the developing roller in order to supply a sufficient amount of toner. Therefore, stress is applied to the toner in the contact section of the toner supply roller and the developing roller, and the toner tends to deteriorate. Another problem is an increase in the torque of the developing roller.

When the fiber brush is used as the toner supply roller, the toner supply roller tends to deteriorate with time, for example, the brush is clogged with the toner or the hair of brush is laid down. When the elastic foam body is used, the toner supply roller also deteriorates with time because the expanded cell is clogged with the toner.

Furthermore, the installation of the toner supply roller and a driving device thereof not only complicates the construction of a development device, but also loses the simplicity of the apparatus that is one of the advantages produced by the use of the single-component developer, and simultaneously increases the cost.

SUMMARY OF THE INVENTION

In view of the above conventional problems, it is an object of the present invention to provide a development apparatus capable of producing a high-density image in a stable manner with little stress applied to toner and little deterioration with time, by supplying a sufficient amount of a nonmagnetic single-component developer according to a simple low-cost method without using a developer supply member.

In order to achieve the above object, a development apparatus of the present invention includes:

- a developer carrier for transporting a nonmagnetic single-component developer by carrying the nonmagnetic single-component developer on a surface thereof;
- a regulating member for forming a thin layer of the nonmagnetic single-component developer on the surface of the developer carrier by regulating an amount of the nonmagnetic single-component developer to be transported by the developer carrier; and
- a developer guide member for guiding the nonmagnetic single-component developer to the regulating member so as to increase developer pressure to be applied to the developer carrier by the nonmagnetic single-component developer transported to the regulating member, the developer guide member being disposed out of contact with the developer carrier in a position proximate to an upstream side of the regulating member with respect to a moving direction of the developer carrier.

With the above-mentioned structure of the development apparatus, the regulating member regulates the amount of the nonmagnetic single-component developer (hereinafter referred to as toner) to be transported so as to produce an even thin layer of the toner. Therefore, most of the toner transported by a movement of the developer carrier cannot pass through the regulating member. As a result, on an upstream side of the regulating member with respect to a moving direction of the developer carrier, the toner which has been pushed back by the regulating member goes away from the surface of the developer carrier and tends to move upward along the surface of the regulating member.

When the toner tends to flow upward, the developer guide member pushes the toner back to the surface of the developer carrier. Since the developer carrier successively transports new toner, developer pressure (i.e., developer density) to be applied to the developer carrier by the toner transported to the regulating member increases, thereby permitting satisfactory toner supply capacity.

Accordingly, it is possible to improve the toner supply capacity without providing a developer supply member for supplying toner in contact with the developer carrier, and produce a stable high-density image without density changes even if a document has an entirely black solid image. Moreover, since the developer guide member is arranged out of contact with the developer carrier, the developer carrier can be driven with low torque, and the stress on the toner can be reduced. This arrangement allows a development apparatus capable of reducing deterioration of the toner and the apparatus with time. It is also possible to simplify the apparatus (i.e., to reduce the size of the apparatus), and lower the cost.

It is preferable that the developer guide member is formed of an elastic material. With the use of the elastic material, the toner is elastically pushed back, i.e., part of the toner is caused to flow toward the upstream side of the developer carrier. Furthermore, since the excessive pressure of the toner is absorbed by the elastic developer guide member, it is possible to prevent an excessive developer pressure to be applied to the developer carrier by the toner transported to the regulating member. Shortly, it is possible to prevent agglomeration of the toner on the upstream side of the regulating member. As a material for the developer guide member, an elastic foam body is particularly suitable because it has low hardness, is inexpensive and easy to obtain. By forming the developer guide member using the elastic foam body, it is possible to achieve a reduction in the cost.

It is also preferable that the regulating member has a nip section which is pushed against the developer carrier with a desired nip width, the developer guide member is a free end section provided on the upstream side of the nip section, and the hardness of the free end section is made lower than that of the nip section. With this arrangement, an upper portion of the toner on the developer carrier, transported in the vicinity of the developer guide member, i.e., the free end section, is regulated so that the toner has a layer thickness determined between the developer carrier and the free end section and flows underneath the nip section with a movement of the developer carrier. At this time, most of the toner regulated by the nip section tends to flow upward from the regulating member. However, the toner is pushed back by the free end section, and therefore increases the developer pressure (i.e., developer density) in the toner inflow section under the nip section. As a result, the toner more strongly adheres to the developer carrier.

In this case, if the hardness of the free end section is made equal to that of the nip section, the density of the developer flowing under the nip section becomes excessively high, and the possibility of agglomeration of the toner between the free end section and the developer carrier increases. Therefore, by arranging the hardness of the free end section to be lower than the hardness of the nip section, for example, around Askar C 40°, the free end section is warped by the pressure of the toner, thereby preventing an excessive increase in the density of the developer flowing underneath the nip section. Consequently, the agglomeration of the toner does not occur, and a suitable amount of the toner is supplied. It is thus possible to efficiently supply the toner to the nip section.

Alternatively, the relative hardness of the free end section with respect to the nip section may be lowered by using materials of the same hardness for the nip section and the free end section, and by arranging the nip section and the free end section to have different thicknesses or forming holes in the free end section.

For a fuller understanding of the nature and advantages of the invention, reference should be made to the ensuing detailed description taken in conjunction with the accompanying drawings.

DESCRIPTION OF THE PREFERRED EMBODIMENTS

The following description will discuss one embodiment of the present invention with reference to FIGS. 1 to 6.

Figure 1:
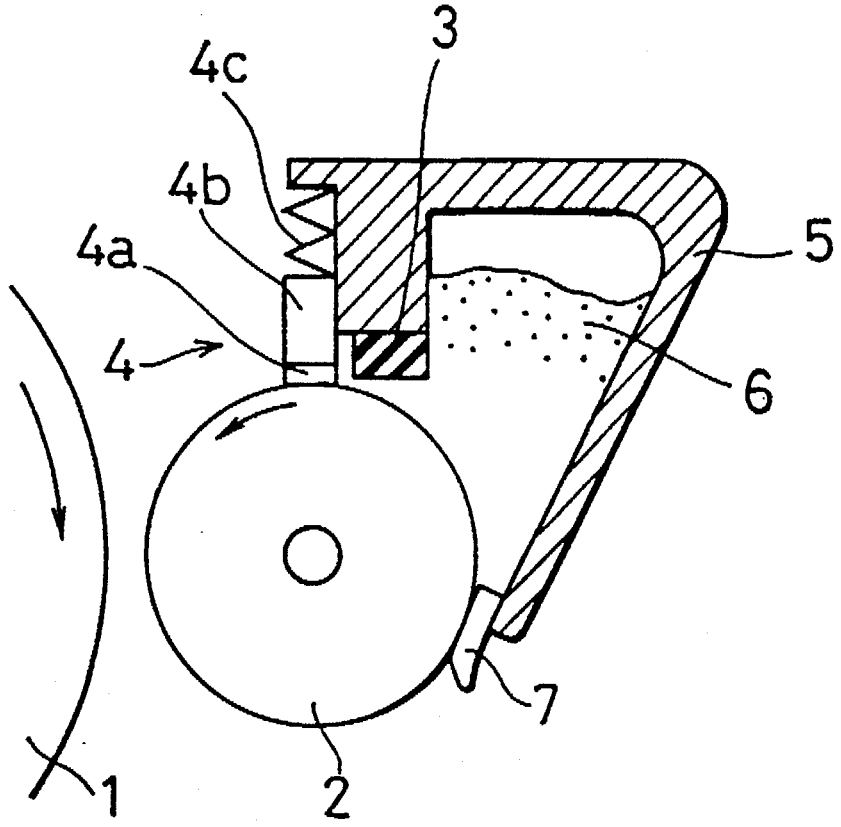
FIG. 1 is a schematic view showing a development apparatus according to one embodiment of the present invention.

As illustrated in FIG. 1, a development apparatus of this embodiment is disposed to face a photoreceptor 1 (electrostatic latent image carrier) which rotates clockwise and on which an electrostatic latent image is formed by latent image forming means, not shown. The development apparatus includes a developing roller 2 (developer carrier), a developer guide member 3, a developer regulating member 4, a developer reservoir 5, and a toner seal member 7. Toner 6 (nonmagnetic single-component developer) is stored in the developer reservoir 5.

The developing roller 2 is positioned to close an opening section formed at a lower part of the developer reservoir 5. With a rotation of the developing roller 2 in a counterclockwise direction, a toner layer is formed on the surface of the developing roller 2 and the toner 6 is transported to the photoreceptor 1. The developer regulating member 4 includes a blade 4*a* (regulating member), a blade supporting member 4*b*, and a blade pushing member 4*c*. The blade 4*a* and the blade supporting member 4*b* are pushed against the developing roller 2 by the blade pushing member 4*c*.

The developer guide member 3 is fastened inside the developer reservoir 5, on an upstream side proximate to the developer regulating member 4 in the rotating direction of the developing roller 2. The developer guide member 3 is separated from the developing roller 2 by a predetermined distance and is not in contact with the developing roller 2. The developer guide member 3 guides the toner 6 to an inflow position under the blade 4*a*.

With this structure, development is performed as follows. When the developing roller 2 is rotated counterclockwise, the toner 6 in the vicinity of the developing roller 2 in the developer reservoir 5 adheres to and is transported by the developing roller 2. The toner 6 transported to the vicinity of the developer guide member 3 is regulated to have a layer thickness which is determined by the space between the developing roller 2 and the developer guide member 3. Additionally, the toner 6 is pushed against the developing roller 2 by the developer guide member 3, and therefore more strongly adheres to the developing roller 2.

Thereafter, the toner 6 transported to the blade 4*a* with a rotation of the developing roller 2 is charged by friction with the blade 4*a* or by charge injection, and is shaped into a thin layer by the blade 4*a*. After passing through the blade 4*a*, a thin layer of the toner 6 is formed on the developing roller 2, and is transported to a development area where the developing roller 2 faces the photoreceptor 1 by a rotation of the developing roller 2.

In the development area, the toner 6 on the developing roller 2, which corresponds to the electrostatic latent image formed on the photoreceptor 1, is transferred to the photoreceptor 1 and forms a visible image. At this time, a direct current or a voltage produced by superimposing an alternating current on a direct current, may be applied as a developing bias to the developing roller 2.

The flow of the toner 6 in the vicinity of the developer guide member 3 will be explained in detail below. Most of the toner 6 transported by the developing roller 2 is regulated by the blade 4*a*. As a result, on an upstream side of the blade 4*a*, the regulated toner 6 flows in an upward direction from the vicinity of the developing roller 2 along the surfaces of the blade 4*a* and the blade supporting member 4*b*.

Figure 2B:
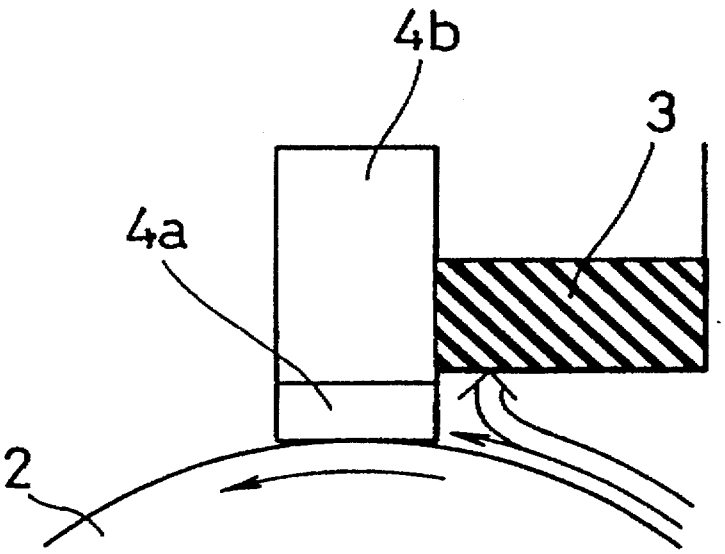
FIG. 2(*a*) is an explanatory view showing the flow of toner in the vicinity of a conventional blade, and FIG. 2(*b*) is an explanatory view showing the flow of toner in the vicinity of a blade of this embodiment.
Figure 2A:
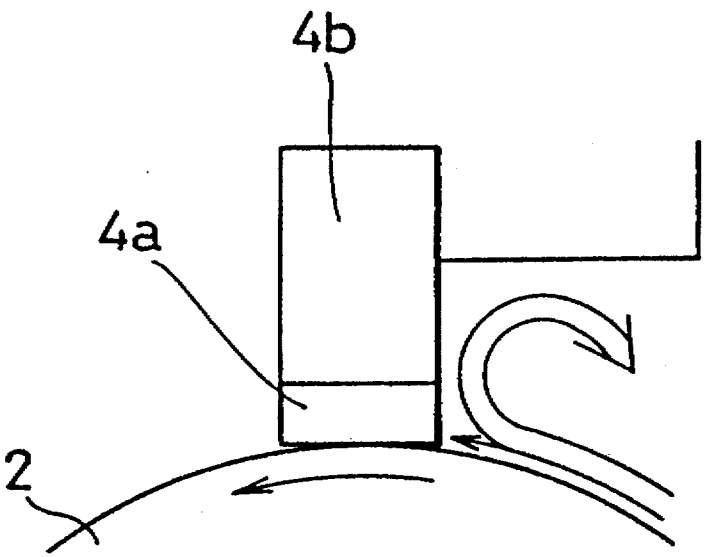

If the developer guide member 3 is not present, as illustrated in FIG. 2(*a*), the toner 6 regulated by the blade 4*a* is pushed out by newly supplied toner 6 and flows in the upward direction along the surfaces of the blade 4*a* and the blade supporting member 4*b*. Then, the toner 6 flows toward the upstream side of the developing roller 2 while moving in an arc of a circle.

On the other hand, if the developer guide member 3 is present, as illustrated in FIG. 2(*b*), the flow of the toner 6 in the upward direction is prevented, and the flow of the toner 6 toward the upstream side of the developing roller 2 is reduced. Moreover, since the toner 6 is pushed back by the developer guide member 3 and since the developing roller 2 successively transports new toner 6, a toner pressure as a developer pressure (i.e., toner density) in the toner inflow section under the blade 4*a* increases. As a result, the toner 6 strongly adheres to the developing roller 2, and is efficiently supplied.

Therefore, the developer guide member 3 performs a function different from a conventional developer supply member such as a toner supply roller which is disposed in contact with the developing roller 2, and can supply an increased amount of the toner 6. In addition, since the developer guide member 3 can be arranged to be out of contact with the developing roller 2, it is possible to drive the developing roller 2 with a low torque, and decrease stress on the toner 6. It is also possible to simplify the apparatus and reduce the cost.

Furthermore, as described above, the developer guide member 3 pushes the toner 6 flowing in the upward direction back to the surface of the developing roller 2. The developer guide member 3 elastically returns the toner 6 because it is formed by an elastic material. Namely, part of the toner 6 is caused to flow toward the upstream side of the developing roller 2. Moreover, since an excess of pressure of the toner 6 is absorbed by the elastic developer guide member 3, it is possible to prevent an excessive toner pressure from being applied to the developing roller 2 by the toner 6 transported to the blade 4*a*. Shortly, it is possible to prevent gathering of the toner 6 on the upstream side of the blade 4*a*. Although the material of the developer guide member 3 will be discussed in detail later, an elastic foam body is preferable because it has low hardness, is inexpensive and easy to obtain.

The following description will explain in detail the specifications of the development apparatus of this embodiment. The photoreceptor 1 is a so-called OPC drum having a photoreceptor layer made of an organic photoconductor substance, for example, phthalocyanine, on an aluminum cylinder with a diameter of 80 mm and a length of 340 mm. The photoreceptor 1 was rotated clockwise at a circumferential speed of 175 mm per second. Alternatively, it is possible to use a photoreceptor having a photoreceptor layer made of a photoconductor substance such as CdS, Se, a-Si (amorphous silicon) and ZnO. The photoreceptor is not limited to be cylindrical in shape, and may be formed by an endless belt that turns round when driven.

The developing roller 2 was formed by an aluminum cylinder having a diameter of 32 mm, a length of 290 mm and a surface which was sandblasted to produce a center line average roughness of 1.5 μm. The developing roller 2 was disposed 0.15 mm distant from the photoreceptor 1, and rotated counterclockwise at a circumferential speed of 300 mm per second. Alternatively, the developing roller 2 may be formed by a so-called elastic roller having an elastic surface layer on an electrically conductive shaft made of metal such as aluminum and stainless steel. The developing roller 2 is not limited to be cylindrical in shape, and may be formed by an endless belt that turns round when driven. The developing roller 2 is not necessarily out of contact with the photoreceptor 1. Namely, the developing roller may be in contact with the photoreceptor 1.

The blade 4*a* is a urethane elastic body with a thickness of 2 mm, a length of 292 mm, a width of 5 mm, a volume resistivity of $10^5$ Ωcm, and a hardness of JIS (Japanese Industrial Standard) A 50°. The blade pushing member 4*c* is formed by a coil spring, a plate spring, and the like. The blade 4*a* was fastened to the blade supporting member 4*b*, and pushed against the developing roller 2 with a nip width of 2 mm by a linear load of 80 gf per centimeter. The linear load is preferably within a range of 20 to 200 gf per centimeter. It is possible to adjust the amount of adhering toner, the thickness of a toner layer and the charge of toner on the developing roller 2 by changing the pushing force. As the materials for the blade 4*a*, for example, an elastic body made of silicon, polyamide, acrylic and epoxy resin can be used. When the developer carrier is formed by an elastic body, it is possible to use metal, for example, aluminum, stainless steel, copper, brass, and phosphor bronze.

The toner 6 is a nonmagnetic single-component toner which is produced by mixing a coloring agent such as a carbon with a resin, for example, styrene acrylate as a principal resin, grinding and classifying the mixture. In order to improve the flowability, a hydrophobic alumina is added. The volume mean particle diameter and volume resistivity of the toner 6 are 7 μm and $10^{11}$ Ωcm, respectively. The toner 6 is charged in a positive polarity. The structure of this embodiment can be carried out irrespectively of the polarity of charge, and can use toner charged in a negative polarity. As the principal resin, it is possible to use polyester, epoxy, polystyrene, and acrylic resins. The toner 6 may be produced by using, for example, silica or titanium oxide as an additive and may be colored using pigment or dye. The toner 6 may be produced by polymerization or micro-encapsulation.

The developer guide member 3 was made of a rectangular parallelepiped urethane rubber foam with a thickness of 5 mm, a width of 10 mm, a length of 292 mm, a hardness of Askar C 20°, one hundred expanded cells per inch and 5% compression set. Alternatively, the developer guide member 3 may be formed by an elastic body made of rubber materials such as polyurethane, silicon, CR (chloroprene rubber), polystyrene, polyethylene, nitrile and butadiene, or the foam body thereof. The surface of the elastic foam body may be coated. The developer guide member 3 is not limited to a rectangular parallelepiped shape, and may be formed into the shape of a cylinder.

In order to examine the relation between the hardness and the relative position of the developer guide member 3 and the toner supply capacity, Experiments 1 to 3 were carried out using the above development apparatus. In addition, Experiment 4 was executed to examine the state of the toner layer.

The development apparatus was installed in a copying machine "SF8300" of Sharp Corporation, and an A4R black solid document was copied by rotating the photoreceptor 1 and the developing roller 2 at a circumferential speed ratio of 1:1.7 (the circumferential speed of the developing roller 2 was 300 mm per second). A copy of one document (copy sample) is produced when the developing roller 2 rotates about five times, depending on the relation between the circumference of the developing roller 2 and its circumferential speed. The positions of the copy sample corresponding to the respective rotations of the developing roller 2, i.e., the optical density (O.D.) on five points on a sheet of copy sample was measured using Machbeth RD918 so as to examine changes in the optical density. If the developer supply capacity, i.e., toner supply capacity is satisfactory, the density is not decreased by each rotation of the developing roller 2, and a high-density copy (with O.D. not lower than 1.4) is produced.

Figure 3:
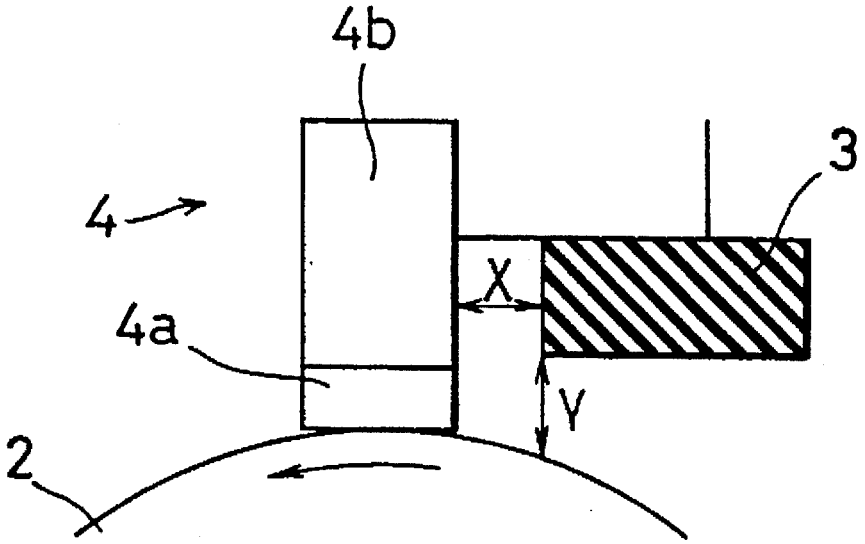
FIG. 3 is an explanatory view showing the relation between the position of a developer guide member and the positions of a developing roller and a blade.

First, Experiments 1 and 2 were carried out so as to examine the relation between the positions of the developer guide member 3 and the developing roller 2 and the toner supply capacity. At this time, the developer guide member 3 was formed of the urethane rubber foam. In FIG. 3, the distance between a downstream-side surface of the developer guide member 3 and an upstream-side surface of the developer regulating member 4 (distance in a horizontal direction) is represented by X, while the minimum distance between the developer guide member 3 and the developing roller 2 (distance in a vertical direction) is indicated as Y.

Figure 4:
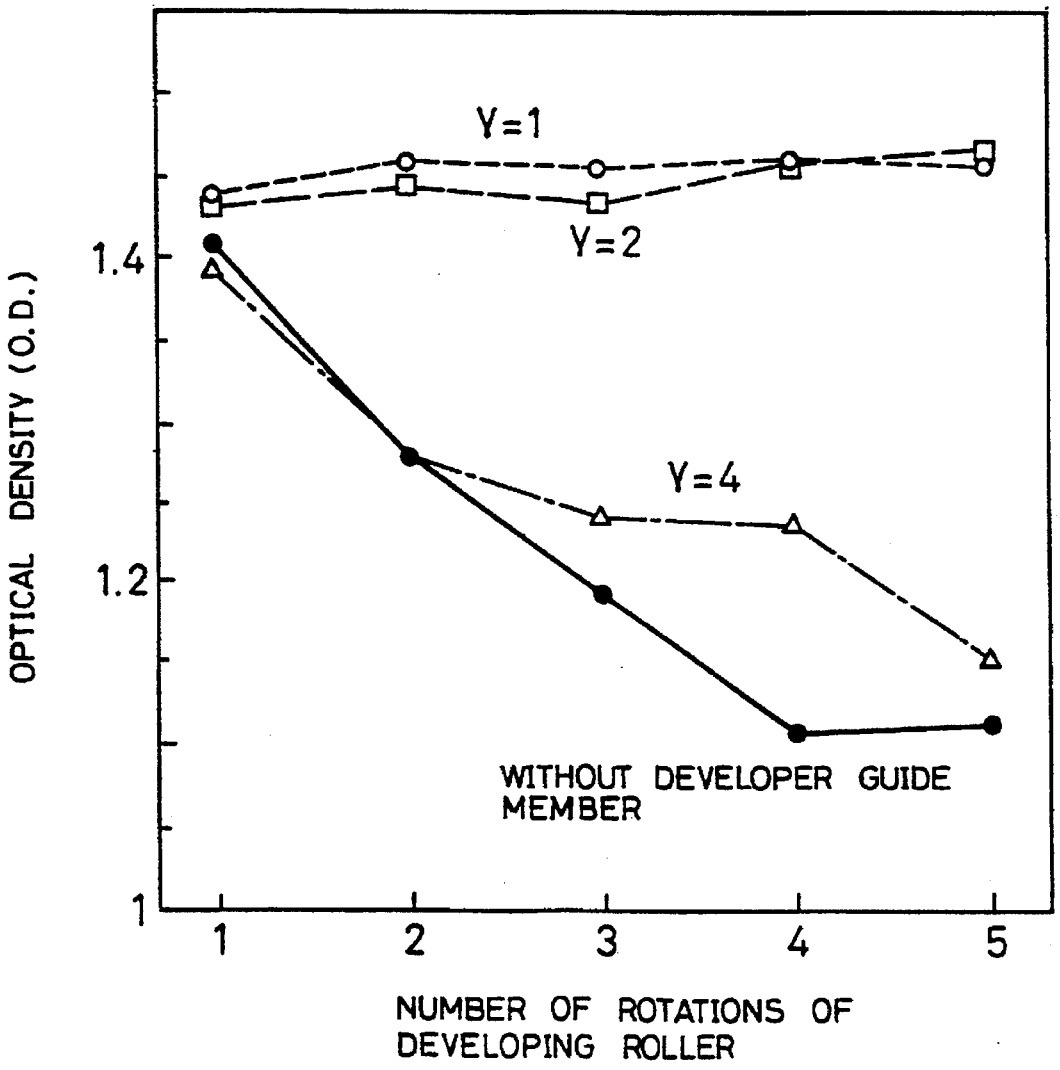
FIG. 4 is a graph showing changes in the toner supply capacity depending on the positional relation between the developer guide member and the developing roller.

Experiment 1 was performed to study the relation between the toner supply capacity and distance Y, when distance X was zero, i.e., the developer regulating member 4 and the developer guide member 3 were in close contact with each other. In FIG. 4, the relation between the number of rotations of the developing roller 2 and the optical density of the copy sample was shown as a result of the experiment.

As shown in FIG. 4, when Y was 1 or 2 (mm), the optical density was substantially uniform, and a lowering of the density with an increase in the number of rotations of the developing roller 2 was not observed. Moreover, the optical density was not lower than 1.4, and thus a high-density image was obtained. Accordingly, the toner supply capacity was satisfactory. On the other hand, when Y was 4 (mm), i.e., when the distance Y between the developer guide member 3 and the developing roller 2 increased, the optical density was about 1.4 at the first rotation of the developing roller 2. However, a lowering of the density becomes noticeable as the number of rotations of the developing roller 2 increases as shown by a curve slanting down to the right, and the toner supply capacity deteriorates.

The reason for this is that when the distance Y between the developer guide member 3 and the developing roller 2 increases, the toner 6 is regulated by the blade 4*a* and the returned toner 6 further flows toward the upstream side like the case in which the developer guide member 3 is not present as shown in FIG. 2(*a*). Consequently, it is impossible to improve the toner pressure (i.e., toner density) at the inflow section under the blade 4*a* by the developer guide member 3. On the other hand, when the distance Y is too small, i.e., when the developer guide member 3 and the developing roller 2 are too close to or make contact with each other, uneven development such as a stripe occurs, or the toner 6 on the developing roller 2 is scraped off.

Therefore, the optimum range of the distance Y between the developer guide member 3 and the developing roller 2 exists. Experiments were carried out by changing the value of the distance Y. According to the result, the distance Y is preferably between about 0.5 and 3 mm.

Experiment 2 was carried out to study the relation between the distance X and the toner supply capacity when arranging the distance Y to be 1 mm. The relation between the number of rotations of the developing roller 2 and the optical density of a sample copy was shown in FIG. 5 as a result of the experiment.

According to the result, when X was zero and 5 mm, the optical density was substantially uniform and was not lowered depending on the number of rotations of the developing roller 2. At this time, the optical density was not lower than 1.4, and thus a high-density image was obtained. Accordingly, the toner supply capacity was satisfactory. On the other hand, when X was 10 mm, i.e., the space between the developer guide member 3 and the developer regulating member 4, the optical density was about 1.4 at the first rotation of the developing roller 2. However, a lowering of the density became noticeable as the number of the rotations of the developing roller 2 increased as shown by a curve slanting down to the right. Consequently, the toner supply capacity deteriorated.

The reason for this is that when the distance X increases, the toner 6 is regulated by the blade 4*a* and a force for pushing the returned toner 6 back to the inflow section is dispersed. Therefore, the space between the developer guide member 3 and the developer regulating member 4 is preferably small, and more preferably smaller than about 10 mm. Experiments were carried out by changing the value of the distance X. Accordingly, the distance X is preferably not larger than about 5 mm.

Figure 5:
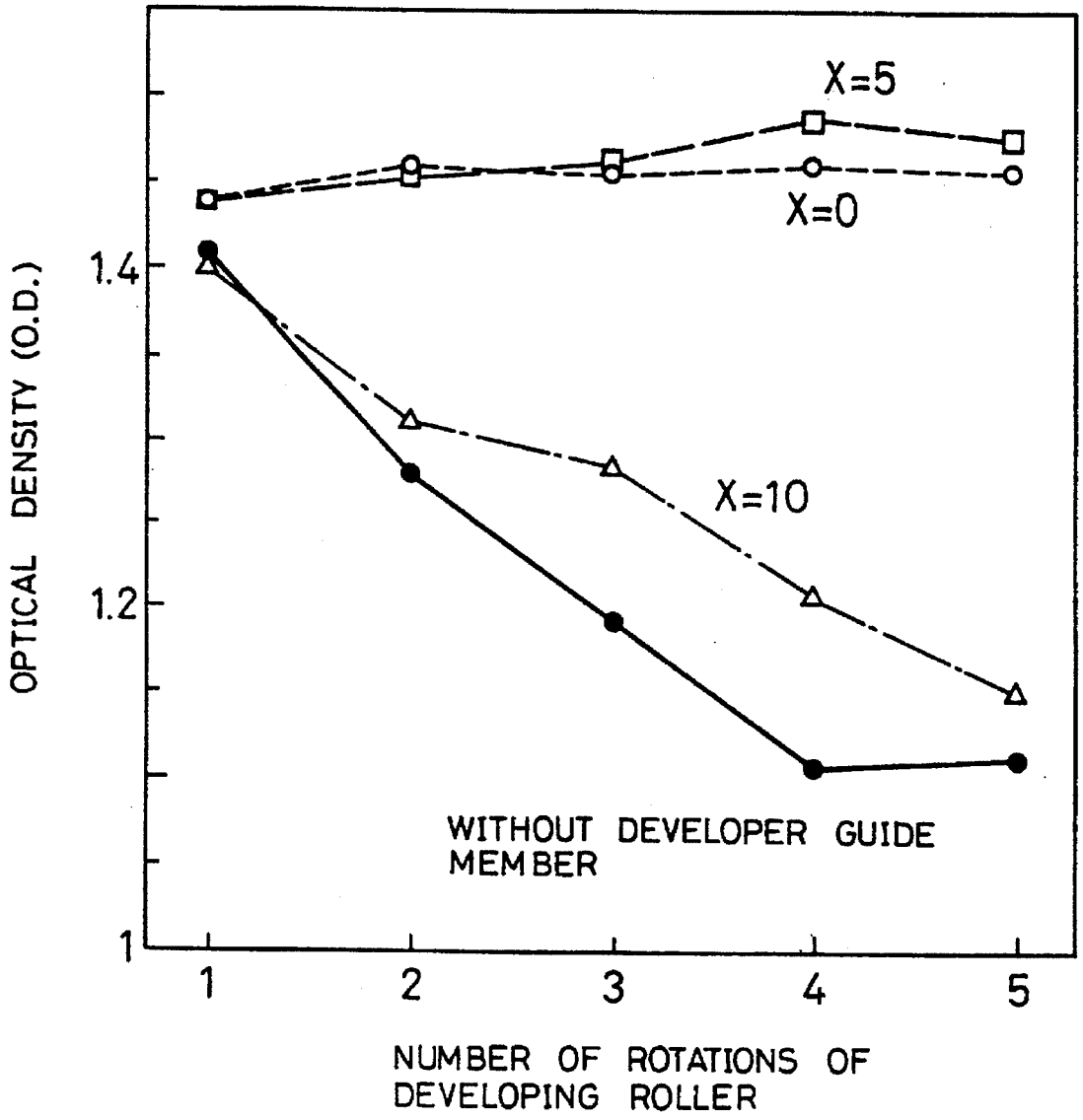
FIG. 5 is a graph showing changes in the toner supply capacity depending on the positional relation between the developer guide member and the blade.
Figure 6:
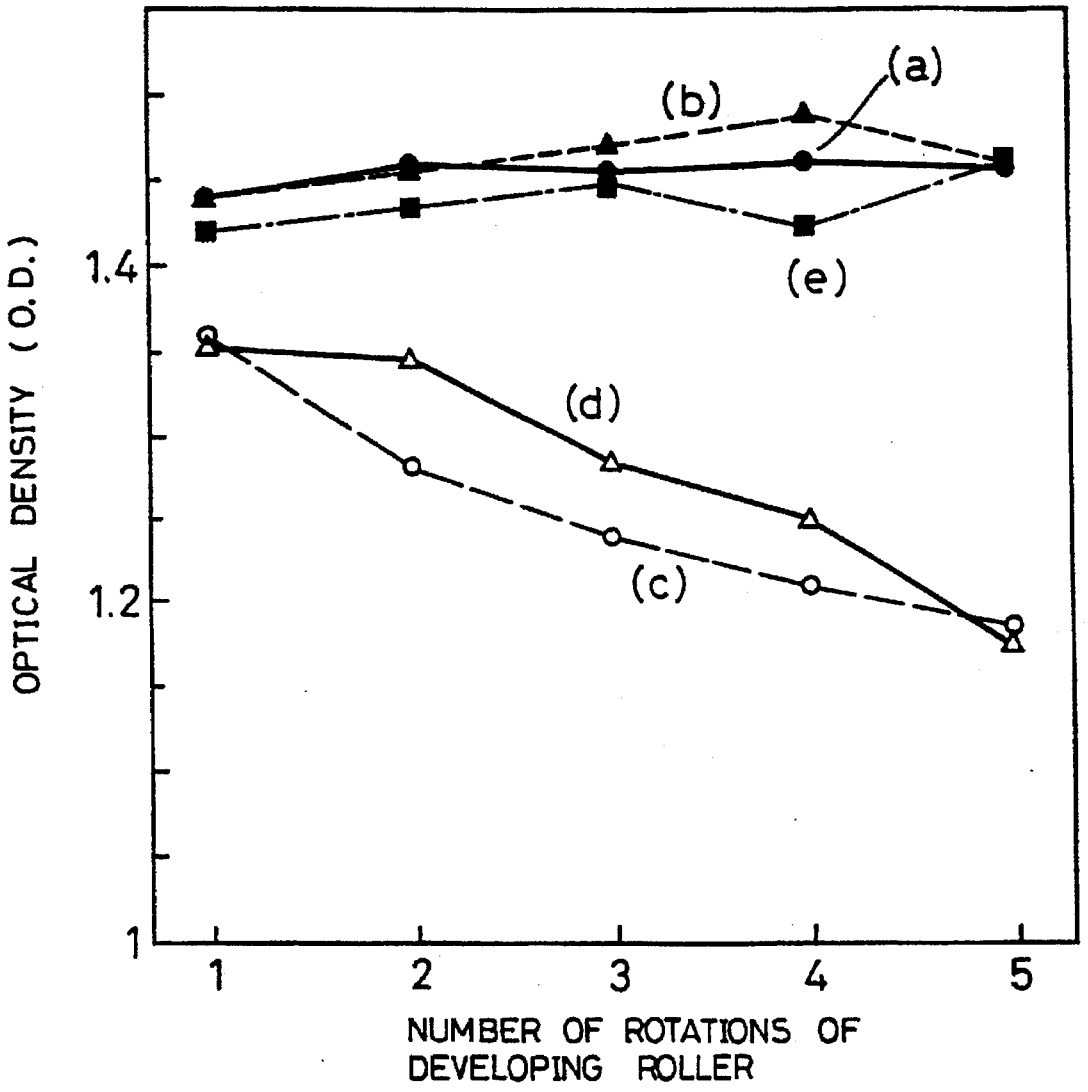
FIG. 6 is a graph showing the relation between the material of the developer guide member and the toner supply capacity.

In order to study the effect of the developer guide member 3, experiments were carried out without using the developer guide member 3 under the same conditions as in Experiments 1 and 2. The results are also shown in FIGS. 4 and 5. The lowering of the density became more noticeable without the developer guide member 3 than with the developer guide member 3, as shown by a curve slanting down to the right in FIGS. 4 and 5. The results reveal that the toner supply capacity deteriorates with the developer guide member 3.

Next, Experiment 3 was carried out to study the relation between the material of the developer guide member 3 and the toner supply capacity. In this experiment, the developer guide member 3 formed by each of the following materials (a) to (e) was used.

(a) Urethane rubber foam with a hardness of Askar C 20°
(b) Urethane rubber foam with a hardness of Askar C 40°
(c) Acrylic plate
(d) Urethane solid rubber with a hardness of JIS A 50°
(e) Urethane rubber foam of (a) whose surface is coated with a mending tape manufactured by 3M The toner supply capacity was examined with respect to each of the above five materials. The distance X between the developer guide member 3 and the developer regulating member 4 was zero, and the distance Y between the developer guide member 3 and the developing roller 2 was 1 (mm). The relation between the number of rotations of the developing roller 2 and the optical density of a copy sample was shown in FIG. 6 as a result of the experiment.

With the developer guide member 3 made of (a), (b) or (e), the optical density was substantially uniform and was not lowered depending on the number of rotations of the developing roller 2. The optical density was not lower than 1.4, and thus a high-density image was obtained. Accordingly, the toner supply capacity was satisfactory. In contrast, with the developer guide member 3 made of (c) or (d), a lowering of the density was noticeable as shown by a curve slanting down to the right. Thus, the toner supply capacity deteriorates. The density was also not higher than 1.4 at the first rotation of the developing roller 2, resulting in a low density.

With the developer guide member 3 made of (e), satisfactory toner supply capacity was obtained like (a). Thus, the state of the surface of the urethane rubber foam and the toner supply capacity are irrelevant to each other. The hardness of the material of (c) was higher than that of (a) and (b). In this case, the toner 6 was agglomerated between the developer guide member 3 and the developing roller 2, resulting in a lowering of the flowability of the toner 6. The hardness of the material of (d) was also higher than that of (a) and (b). In this case, the toner 6 was also agglomerated to a degree less than the agglomeration of (c), and the flowability of the toner 6 was lowered.

In view of the results, in order to prevent the agglomeration of the toner 6 and improve the toner supply capacity, an elastic body with low hardness is preferable for the developer guide member 3. In particular, an elastic foam body or a film-coated elastic foam body is inexpensive, easy to obtain, and provides satisfactory toner supply capacity. If the solid rubber is used for the developer guide member 3, the hardness of the solid rubber is preferably not higher than about JIS A 20°.

Next, Experiment 4 was carried out to study the state of a toner layer formed on the developing roller 2 after passing through the blade 4*a*. A test bench capable of independently driving the above-mentioned development apparatus was used for measurement. The developing roller 2 was driven for about 10 seconds, and the average charge (specific charge) and the amount of toner (adhesion) per unit area of the toner layer formed on the developing roller 2 were measured. In this experiment, the urethane rubber foam was used as the developer guide member 3, the distance X between the developer guide member 3 and the developer regulating member 4 was zero, and the distance Y between the developer guide member 3 and the developing roller 2 was 1 (mm).

In order to measure the specific charge and the adhesion, the toner 6 on the developing roller 2 was removed by suction using a suction device. Then, the mass M of the sucked toner 6, the amount Q of charge remaining on the developing roller 2 and the sucked area A of the developing roller 2 were measured. The specific charge and the adhesion were given by calculating Q/M and M/A, respectively.

According to the results of a number of measurements, the specific charge was 9.1 μC/g, and the adhesion was 0.64 $mg/cm^2$. For comparison, similar measurements were executed when the developer guide member 3 was not used. In this case, the specific charge was 9.8 μC/g, and the adhesion was 0.48 $mg/cm^2$. It is found from the results that the adhesion is increased by the effect of the developer guide member 3. Accordingly, the developing density is improved. Moreover, since the specific charge does not vary much, the toner 6 is sufficiently charged like a conventional structure.

In summary, useful materials for the developer guide member 3 include an elastic body, elastic foam body and film-coated elastic foam body of polyurethane, silicon, polystyrene, and polyethylene. The space between the developer guide member 3 and the developing roller 2 is preferably within a range of about 0.5 and 3 mm, and the space between the developer guide member 3 and the developer regulating member 4 is preferably not larger than about 5 mm.

The following description will discuss another embodiment of the present invention with reference to FIGS. 7 to 10. Members identical to the members shown in the above-mentioned embodiment will be designated by the same code and their description will be omitted.

Figure 7:
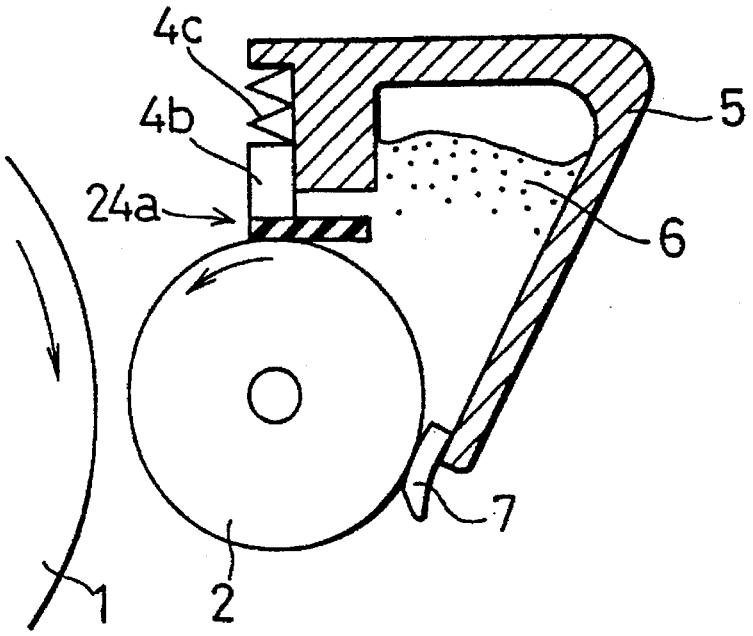
FIG. 7 is a schematic view showing a development apparatus according to another embodiment of the present invention.

As illustrated in FIG. 7, a development apparatus of this embodiment includes a blade 24*a* (regulating member) instead of the developer guide member 3 and the blade 4*a* of the first embodiment. Other structure of this development apparatus is the same as the first embodiment.

Figure 8:
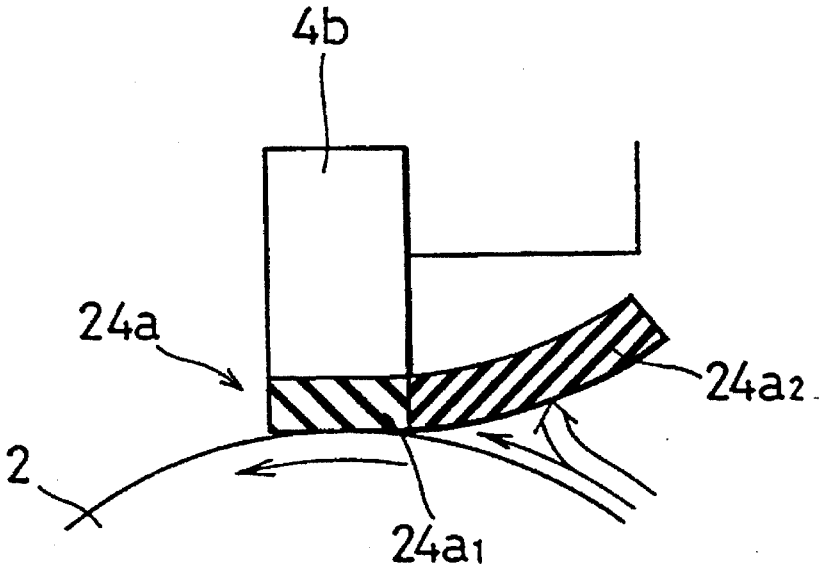
FIG. 8 is an enlarged schematic view showing the vicinity of a blade in the development apparatus.

As shown in FIG. 8, the blade 24*a* includes a nip section $24a_1$ and a free end section $24a_2$ (developer guide member). The nip section $24a_1$ is pushed against the developing roller 2 so that contact of a surface of the nip section $24a_1$ and the developing roller 2 has a desired nip width. The free end section $24a_2$ is formed by extending the nip section $24a_1$ in an upstream direction with respect to the rotating direction of the developing roller 2. Alternatively, the free end section $24a_2$ is fastened to the nip section $24a_1$ by an adhesive agent. Additionally, the free end section $24a_2$ does not come into contact with the developing roller 2 and is not supported by the blade supporting member 4*b*. The hardness of the free end section $24a_2$ is lower than that of the nip section $24a_1$. The details of the hardness will be mentioned later in the explanation of experiments.

When the free end section $24a_2$ and the nip section $24a_1$ are formed by the same material of the same hardness (however, the relative hardness varies), the free end section $24a_2$ is formed by extending the nip section $24a_1$. On the other hand, when the free end section $24a_2$ and the nip section $24a_1$ are formed by the same material but have different hardness, or formed by different materials, the free end section $24a_2$ is fastened to the nip section $24a_1$ by an adhesive agent.

With this structure, the flow of the toner 6 in the vicinity of the blade 24*a* is as follows. In this case, the developing process is performed in the same manner as in the first embodiment.

An upper portion of the toner 6 on the developing roller 2, which is transported to the vicinity of the free end section $24a_2$, is regulated so that the toner 6 has a layer thickness that is determined between the developing roller 2 and the free end section $24a_2$ and is caused to flow underneath the nip section $24a_1$ with a rotation of the developing roller 2. At this time, most of the toner 6 regulated by the nip section $24a_1$ tends to flow upward over the blade 24*a*, but is pushed back by the free end section $24a_2$. As a result, the toner 6 raises the toner pressure (i.e., toner density) at the inflow section for the toner 6 under the nip section $24a_1$, and more strongly adheres to the developing roller 2.

By making the hardness of the free end section $24a_2$ lower than that of the nip section $24a_1$, as shown in FIG. 8, the free end section $24a_2$ is warped by the pressure of the toner 6. This arrangement prevents an excessive increase in the density of the toner 6 flowing underneath the nip section $24a_1$ and agglomeration of the toner 6, thereby permitting supply of a suitable amount of the toner 6. The toner 6 is thus efficiently supplied to the nip section $24a_1$. In the nip section $24a_1$, the toner 6 is charged by friction with the nip section $24a_1$ or by injection of charges, and shaped into a thin layer.

Regarding the specifications of the nip section $24a_1$ of the blade 24*a*, the nip section $24a_1$ is an elastic body made of urethane having a thickness of 2 mm, a length of 292 mm, a volume resistivity of $10^5$ Ωcm, and a hardness of JIS A 50°. The nip section $24a_1$ is fastened to the blade supporting member 4*b* made of aluminum with a width of 5 mm. The nip section $24a_1$ was pushed against the developing roller 2 with a nip width of 2 mm and a linear load of 80 gf per centimeter by the blade pushing member 4*c*. A suitable linear load is between 20 and 200 gf per centimeter. It is possible to adjust the amount of toner adhering to the developing roller 2, and the thickness of the toner layer and the charge of the toner on the developing roller 2 by changing the pushing force. The width of the free end section $24a_2$ of the blade 24*a* was 10 mm, and the hardness thereof was Askar C 50°.

Next, the relation between the hardness of the free end section $24a_2$ and the toner supply capacity was studied by forming the free end section $24a_2$ using each of the following materials (a) to (e).

Figure 9:
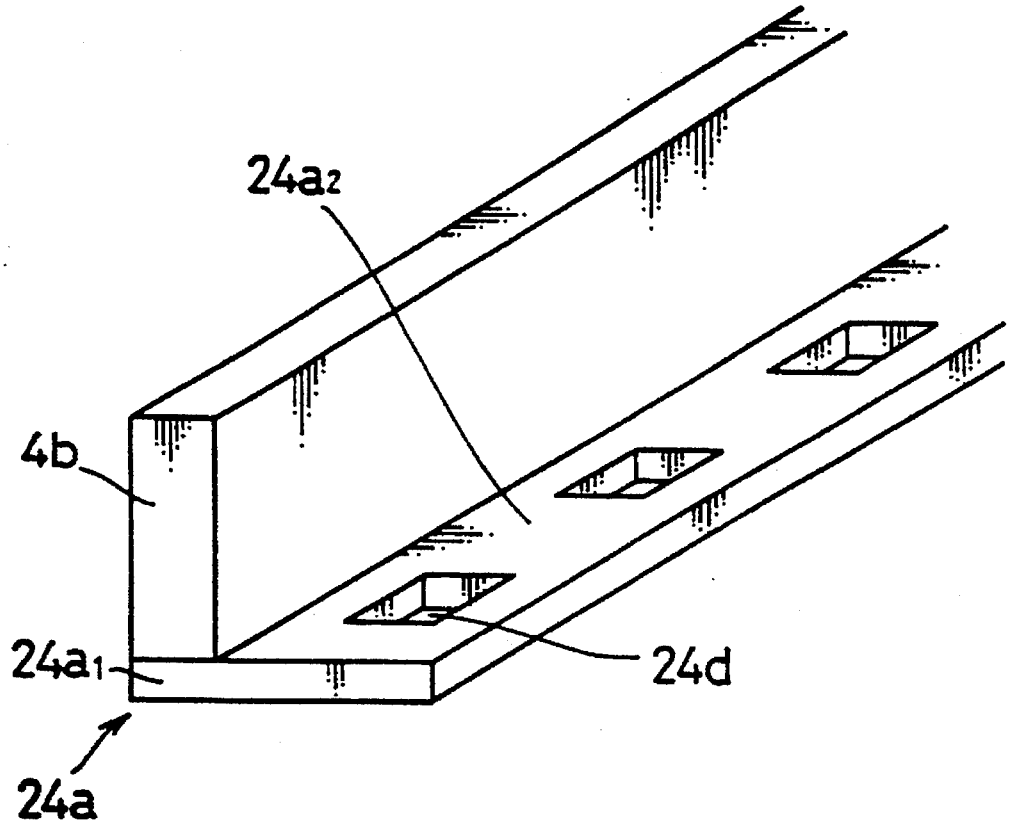
FIG. 9 is a perspective view showing one example of the shape of a free end section of the blade.

(a) Urethane rubber with a hardness of JIS A 50° which is the same as the nip section $24a_1$ (b) Urethane rubber of (a) provided with 2 mm square holes 24*d* arranged at a pitch of 5 mm (see FIG. 9)

(c) Urethane rubber of (a) provided with 5 mm square holes arranged at a pitch of 5 mm (d) Urethane rubber of (c) whose holes are closed by a mending tape manufactured by 3M (e) Urethane rubber foam with a hardness of Askar C 50°

Figure 10:
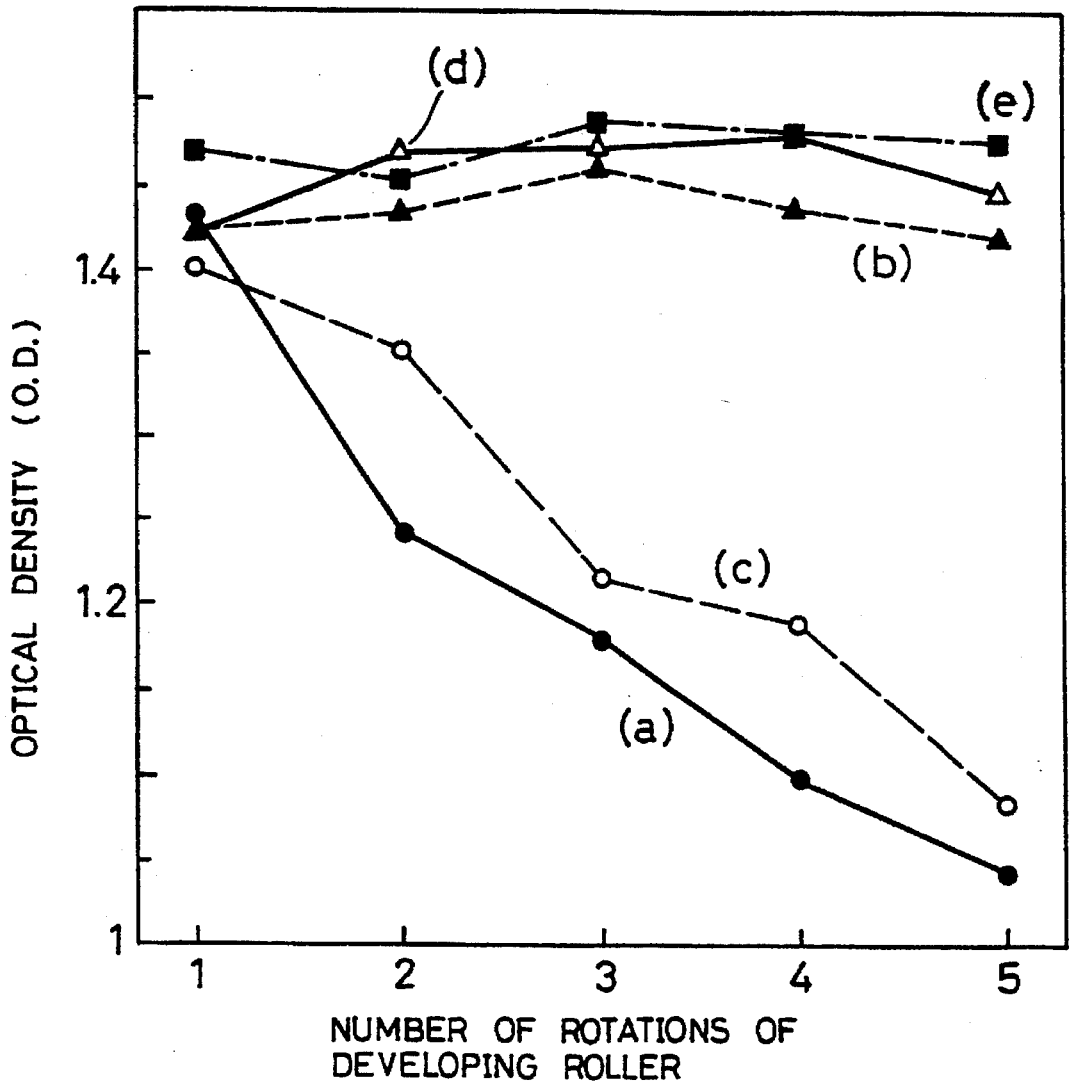
FIG. 10 is a graph showing the relation between the hardness and shape of the free end section and the toner supply capacity.

The toner supply capacity was examined with respect to each of the above five materials. This experiment was performed by the same method as in the first embodiment. The relation between the number of rotations of the developing roller 2 and the optical density of a copy sample is shown in FIG. 10 as the results of the experiment.

According to the results, with the free end section $24a_2$ made of (b), (d) or (e), the optical density is substantially uniform and does not show a lowering of the optical density due to the number of rotations of the developing roller 2. The optical density is not lower than 1.4, and a high-density image is obtained. Accordingly, the toner supply capacity is satisfactory. In contrast, with the free end section $24a_2$ made of (a) or (c), a lowering of the density is noticeable as shown by a curve slanting down to the right, and therefore the density is low. The results can be explained by the substantial hardness (i.e., susceptibility to warp) of the free end section $24a_2$ and the toner pressure (i.e., toner density) at the toner inflow section under the blade 24*a*.

More specifically, when (a) is used, since the free end section $24a_2$ has a relatively high hardness and is hard to warp, the toner 6 returned after being regulated by the nip section $24a_1$ and toner 6 newly supplied by the rotation of the developing roller 2 are agglomerated.

When the free end section $24a_2$ has relatively large holes as mentioned in (c), it is apt to warp, while the agglomeration of toner is hard to happen. However, since the toner 6 flows out through the holes, it is impossible to increase the toner pressure at the toner inflow section under the blade 24*a*.

When the holes 24*d* are made smaller like (b) or the large holes are closed like (d), the agglomeration of toner is hard to happen. Moreover, since the toner pressure at the toner inflow section is improved, it is possible to obtain satisfactory toner supply capacity.

Accordingly, useful materials for the free end section $24a_2$ include an elastic body and an elastic foam body, such as urethane, silicon, polyamide, acrylic, epoxy resin, and natural rubber. When the developer carrier is formed of an elastic body, metal, for example, aluminum, stainless steel, copper, brass, and phosphor bronze can be used for the free end section $24a_2$.

The free end section $24a_2$ is formed by an elastic body or elastic foam body which is the same material as the nip section $24a_1$, but has lower hardness. It is possible to use an elastic body or an elastic foam body made of a material which is different from the one used for the nip section $24a_1$ and has lower hardness. It is also possible to lower the relative hardness of the free end section $24a_2$ with respect to the nip section $24a_1$. Namely, the substantial hardness of the free end section $24a_2$ may be lowered so as to facilitate warp by using a material whose hardness is the same as the nip section $24a_1$, and arranging the thicknesses of the nip section $24a_1$ and the free end section $24a_2$ to be different from each other or forming holes in the free end section $24a_2$.

In order to obtain an even toner layer, for example, the nip section $24a_1$ is preferably formed of a material whose hardness is not lower than about JIS A 40°. A charge imparting substance for effectively charging the toner 6 may be added to the nip section $24a_1$. Alternatively, the nip section $24a_1$ may be coated with a film, or various substances for obtaining desired hardness and electric characteristics may be add to the nip section $24a_1$.

Figure 12B:
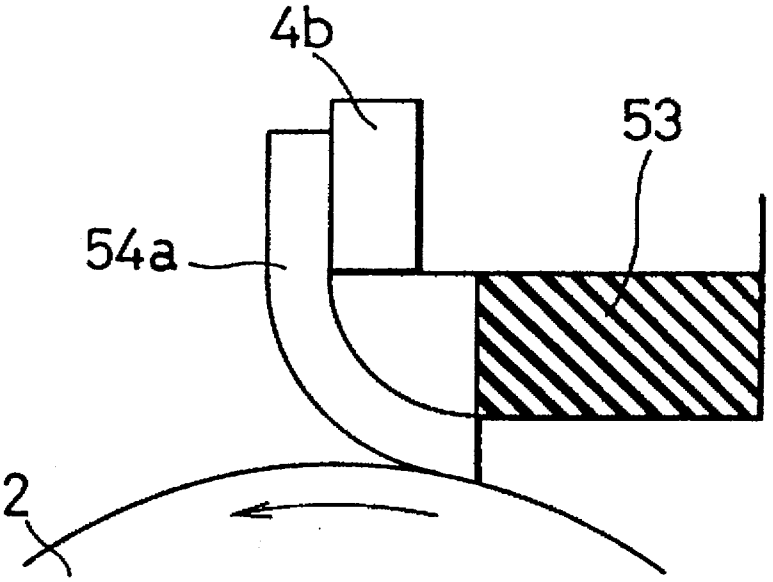
FIGS. 12(*a*) and 12(*b*) are enlarged schematic views showing other examples of the structure in the vicinity of the blade.
Figure 12A:
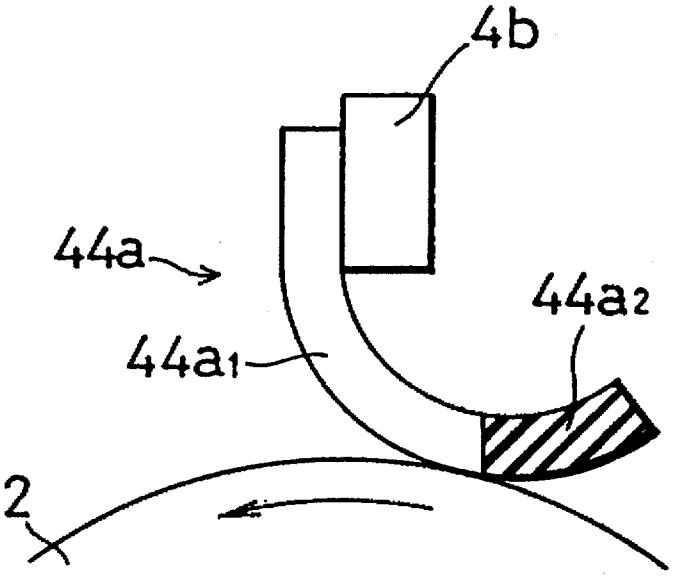
Figure 13:
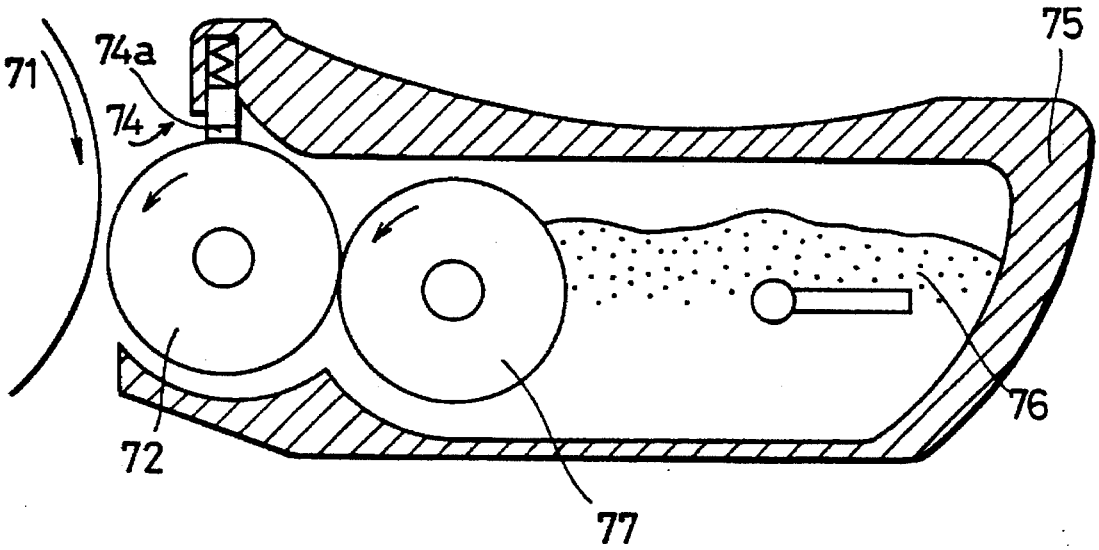
FIG.13 PRIOR ART
FIG. 13 is a schematic view showing an example of a conventional single-component developer device.

As a method for bringing the blade into contact with the developing roller, a method other than those used in the first and second embodiments may be employed. For example, as illustrated in FIGS. 12(*a*) and 12(*b*), blades 44*a* and 54*a* are mounted on the blade supporting members 4*b* in a cantilever-like form so that the side surfaces of the blades 44*a* and 54*a* come into contact with the developing rollers 2. In FIG. 12(*a*), the blade 44*a* is curved when it comes into contact with the developing roller 2, and the curved blade 44*a* warped from the surface of the developing roller 2 has a free end 44*a*2. In FIG. 12(*b*), one end of the blade 54*a* comes into contact with the developing roller 2, and a developer guide member 53 is mounted in the proximity of the end of the blade 54*a*.

Figure 11:
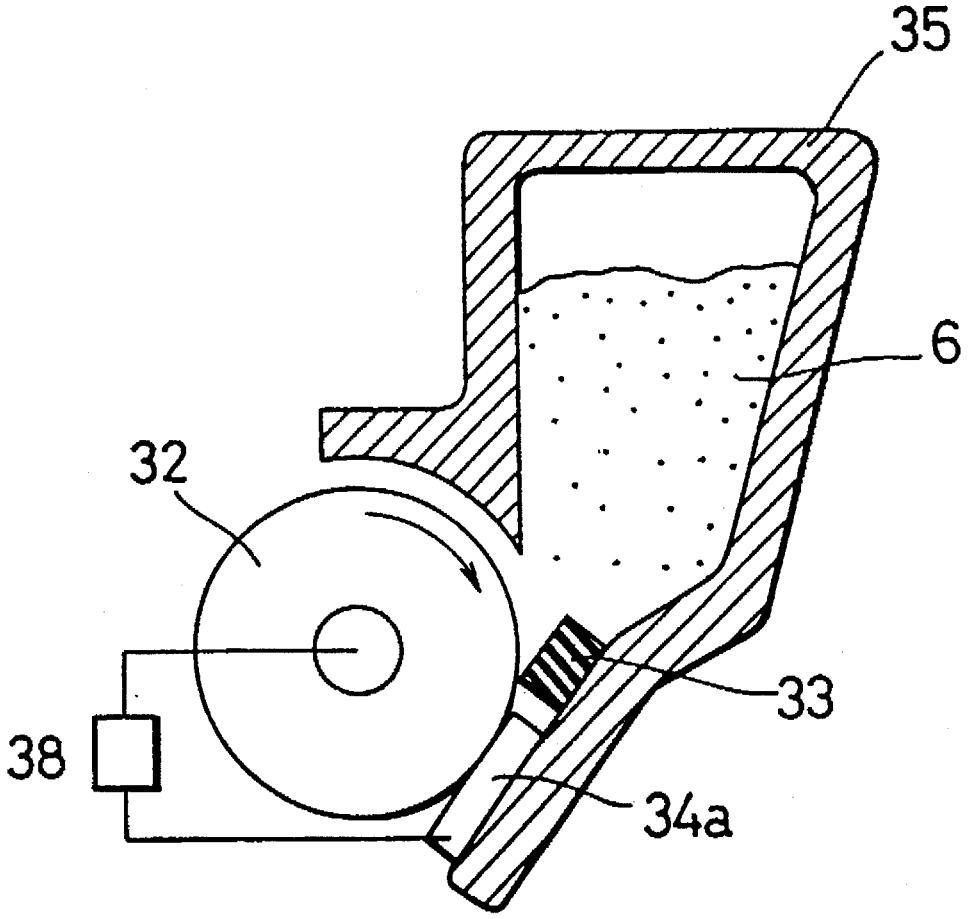
FIG. 11 is a schematic view showing a development apparatus according to still another embodiment of the present invention.

The following description will discuss still another embodiment of the present invention with reference to FIG. 11. Members identical to the members shown in the above-mentioned embodiments will be designated by the same code and their description will be omitted.

As illustrated in FIG. 11, a development apparatus of this embodiment includes a developing roller 32 (developer carrier), a blade 34*a* (regulating member), a developer guide member 33, a developer reservoir 35, and a power source 38. The developer reservoir 35 stores the toner 6.

The developing roller 32 is disposed at a lower part of the developer reservoir 35. With a rotation of the developing roller 32 in a clockwise direction, a toner layer is formed on the surface thereof and the toner 6 is transported to a photoreceptor. The blade 34*a* is mounted on a toner discharge side of the developer reservoir 35, and makes contact with the developing roller 32. The blade 34*a* is used to arrange the toner layer to have a predetermined uniform thickness.

In the developer reservoir 35, the developer guide member 33 is fastened on an upstream side in the rotating direction of the developing roller 32 and in the proximity of the blade 34*a*.

The power source 38 is connected to the blade 34*a* and the developing roller 32 so as to produce a potential difference between the blade 34*a* and the developing roller 32.

With this structure, the developing roller 32 rotates in a clockwise direction, and transports the toner 6 to a position where the developer guide member 33 comes closest to the developing roller 32. In this position, the amount of the toner 6 is adjusted, and the toner 6 is transported to the blade 34*a*.

In the toner inflow section near the blade 34*a*, the toner pressure is increased by the toner 6 supplied and the toner 6 pushed back by the developer guide member 33. The toner 6 is made into a thin layer and simultaneously charged by friction by means of the blade 34*a*. A potential difference is produced between the blade 34*a* and the developing roller 32 by the power source 38, a sufficient amount of charges are given by charge injection, and the toner 6 charged in the opposite polarity is removed. The toner 6 which has passed through the blade 34*a* has a sufficient amount of charges, forms an even thin layer, and is transported to a development area.

The specifications of the above-mentioned development apparatus are as follows. A roller with a center line average surface roughness of 1 μm was formed by sandblasting an aluminum sleeve with a diameter of 25 mm, and used as the developing roller 32. A silicon foam body having a single expandability and a hardness of Askar C 30° was used as the developer guide member 33. The blade 34*a* was made of silicon rubber with a hardness of JIS A 50° and a volume resistivity of $10^5$ Ωcm. The blade 34*a* is pushed against the developing roller 32 with a pushing force of 120 gf per centimeter. The toner 6 was charged in the negative polarity, the developing roller 32 was grounded, and a voltage of −300 V was applied to the blade 34*a* by the power source 38 between the developing roller 32 and the blade 34*a*.

Thus, in the structure of the present invention, by disposing the blade 34*a* on a lower part of the development apparatus as described in the third embodiment, the developing roller can be rotated in a direction opposite to the rotating direction of the developing roller of the first and second embodiments in which the blade is located on an upper part of the development apparatus. It is therefore possible to change the position of the development apparatus with respect to the photoreceptor, and vary the positional relation with other devices, such as charger, transfer, fixing and cleaning devices. Moreover, since the toner 6 is guided to the developer guide member 33 by its own weight, it is possible to use the toner 6 until it is completely consumed, thereby producing the effect of saving the toner 6.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A development apparatus comprising:

a developer carrier for transporting a nonmagnetic single-component developer by carrying the nonmagnetic single-component developer on a surface thereof;

a regulating member for forming a thin layer of the nonmagnetic single-component developer on the surface of said developer carrier by regulating an amount of the nonmagnetic single-component developer to be transported by said developer carrier; and a developer guide member for guiding the nonmagnetic single-component developer to said regulating member by pushing the nonmagnetic single-component developer which has been regulated by said regulating member and which moves apart from the surface of said developer carrier back to said developer carrier so as to increase developer pressure to be applied to said developer carrier by the nonmagnetic single-component developer transported to said regulating member, said developer guide member being disposed out of contact with said developer carrier at a position proximate to an upstream side of said regulating member with respect to a moving direction of said developer carrier.

2. A development apparatus comprising:

a developer carrier for transporting a nonmagnetic single-component developer by carrying the nonmagnetic single-component developer on a surface thereof;

a regulating member for forming a thin layer of the nonmagnetic single-component developer on the surface of said developer carrier by regulating an amount of the nonmagnetic single-component developer to be transported by said developer carrier; and a developer guide member for guiding the nonmagnetic single-component developer to said regulating member so as to increase developer pressure to be applied to said developer carrier by the nonmagnetic single-component developer transported to said regulating member, said developer guide member being disposed out of contact with said developer carrier at a position proximate to an upstream side of said regulating member with respect to a moving direction of said developer carrier, said developer guide member being formed by an elastic material.

3. The development apparatus as set forth in claim 2, wherein said developer guide member is formed of urethane rubber foam.

4. A development apparatus comprising:

a developer carrier for transporting a nonmagnetic single-component developer by carrying the nonmagnetic single-component developer on a surface thereof;

a regulating member for forming a thin layer of the nonmagnetic single-component developer on the surface of said developer carrier by regulating an amount of the nonmagnetic single-component developer to be transported by said developer carrier; and a developer guide member for guiding the nonmagnetic single-component developer to said regulating member so as to increase developer pressure to be applied to said developer carrier by the nonmagnetic single-component developer transported to said regulating member, said developer guide member being disposed out of contact with said developer carrier at a position proximate to an upstream side of said regulating member with respect to a moving direction of said developer carrier, a minimum distance between said developer guide member and said developer carrier being within a range between 0.5 mm and 3 mm.

5. A development apparatus comprising:

a developer carrier for transporting a nonmagnetic single-component developer by carrying the nonmagnetic single-component developer on a surface thereof;

a regulating member for forming a thin layer of the nonmagnetic single-component developer on the surface of said developer carrier by regulating an amount of the nonmagnetic single-component developer to be transported by said developer carrier; and a developer guide member for guiding the nonmagnetic single-component developer to said regulating member so as to increase developer pressure to be applied to said developer carrier by the nonmagnetic single-component developer transported to said regulating member, said developer guide member being disposed out of contact with said developer carrier at a position proximate to an upstream side of said regulating member with respect to a moving direction of said developer carrier, a minimum distance between said developer guide member and said regulating member being not greater than 5 mm.

6. A development apparatus comprising:

a developer carrier for transporting a nonmagnetic single-component developer by carrying the nonmagnetic single-component developer on a surface thereof;

a regulating member for forming a thin layer of the nonmagnetic single-component developer on the surface of said developer carrier by regulating an amount of the nonmagnetic single-component developer to be transported by said developer carrier; and a developer guide member for guiding the nonmagnetic single-component developer to said regulating member so as to increase developer pressure to be applied to said developer carrier by the nonmagnetic single-component developer transported to said regulating member, said developer guide member being disposed out of contact with said developer carrier at a position proximate to an upstream side of said regulating member with respect to a moving direction of said developer carrier, said regulating member including a nip section which is pushed against said developer carrier with a desired nip width, said developer guide member being a free end section arranged on the upstream side of said nip section, a hardness of said free end section being lower than a hardness of said nip section.

7. The development apparatus as set forth in claim 6, wherein said free end section is formed of an elastic material.

8. The development apparatus as set forth in claim 7, wherein said free end section is formed by a material equal to a material of said nip section by extending said nip section in a direction of the upstream side.

9. The development apparatus as set forth in claim 7, wherein said free end section is fastened to said nip section by an adhesive agent.

10. The development apparatus as set forth in claim 7, wherein said free end section includes a plurality of holes of a predetermined size at a uniform pitch so that the hardness of said free end section becomes substantially lower than the hardness of said nip section.

11. The development apparatus as set forth in claim 7, wherein a thickness of said free end section is adjusted so that the hardness of said free end section becomes substantially lower than the hardness of said nip section.

12. The development apparatus as set forth in claim 1, further comprising a developer reservoir for storing the nonmagnetic single-component developer, said regulating member and said developer guide member being disposed on a lower part of said developer reservoir.

13. A development apparatus comprising:

a developer carrier for transporting a nonmagnetic single-component developer by carrying the nonmagnetic single-component developer on a surface thereof;

a regulating member for forming a thin layer of the nonmagnetic single-component developer on the surface of said developer carrier by regulating an amount of the nonmagnetic single-component developer to be transported by said developer carrier;

a developer guide member for guiding the nonmagnetic single-component developer to said regulating member so as to increase developer pressure to be applied to said developer carrier by the nonmagnetic single-component developer transported to said regulating member, said developer guide member being disposed out of contact with said developer carrier at a position proximate to an upstream side of said regulating member with respect to a moving direction of said developer carrier; and a power source for producing a potential difference between said developer carrier and said regulating member.

* * * * *